US008458845B1

(12) United States Patent
Tabieros

(10) Patent No.: US 8,458,845 B1
(45) Date of Patent: Jun. 11, 2013

(54) PIPE CLEANING DEVICE

(76) Inventor: Robert E. Tabieros, Santa Cruz, CA (US)

( * ) Notice: Subject to any disclaimer, the term of this patent is extended or adjusted under 35 U.S.C. 154(b) by 649 days.

(21) Appl. No.: 12/686,782

(22) Filed: Jan. 13, 2010

(51) Int. Cl.

| | |
|---|---|
| ***F16L 45/00*** | (2006.01) |
| ***F16L 55/00*** | (2006.01) |
| ***B08B 1/00*** | (2006.01) |
| ***B08B 7/00*** | (2006.01) |
| ***B08B 9/02*** | (2006.01) |
| ***B08B 9/00*** | (2006.01) |

(52) U.S. Cl.
USPC ..... 15/104.2; 15/104.31; 15/104.33; 15/104.09; 15/104.05

(58) Field of Classification Search
USPC ..... 15/104.2, 104.05, 104.66, 104.09, 15/104.16, 104.31, 104.33, 104.067, 104.095, 15/176.1, 176.3, 176.6, 179, 104.066; D8/382; D32/14; 24/460, 590.1, 413, 589.1, 595.1; 285/219, 404; 403/109.4, 118, 109.5, 109.6, 403/116, 378, 379.3, 379.5, 359.5, DIG. 7, 403/379.4
See application file for complete search history.

(56) References Cited

U.S. PATENT DOCUMENTS

| | | | | | |
|---|---|---|---|---|---|
| 462,156 | A | * | 10/1891 | Pederson | 15/200 |
| 566,110 | A | | 8/1896 | Wrigley | |
| 750,357 | A | * | 1/1904 | Gibbons | 15/160 |
| 862,824 | A | * | 8/1907 | Howell | 15/104.16 |
| 1,154,369 | A | * | 9/1915 | Browning | 15/160 |
| 1,780,436 | A | * | 11/1930 | Miller | 15/104.33 |
| 1,796,337 | A | * | 3/1931 | Moore | 15/104.2 |
| 1,918,353 | A | * | 7/1933 | Utley | 15/104.33 |
| 1,984,964 | A | * | 12/1934 | Clark et al. | 15/104.33 |
| 2,158,577 | A | * | 5/1939 | Haley | 15/104.095 |
| 2,279,769 | A | * | 4/1942 | Von Bon Horst et al. | 24/523 |
| 2,288,771 | A | * | 7/1942 | Babcock | 15/104.09 |
| 2,298,975 | A | * | 10/1942 | Shelburne | 408/204 |
| 2,824,322 | A | * | 2/1958 | Angelica et al. | 15/104.09 |
| 2,836,838 | A | * | 6/1958 | Kollmann | 15/104.09 |
| 2,880,435 | A | * | 4/1959 | Deutsch et al. | 15/104.33 |
| 2,892,649 | A | * | 6/1959 | Kollmann | 403/182 |
| 3,118,159 | A | * | 1/1964 | Kollmann | 15/104.33 |
| 3,390,897 | A | * | 7/1968 | Moore | 285/33 |
| 3,616,479 | A | * | 11/1971 | De Hart | 15/104.31 |
| D266,035 | S | | 9/1982 | Thompson | |
| D289,575 | S | * | 4/1987 | Schneider | D32/14 |
| 4,706,321 | A | * | 11/1987 | Kaye | 15/104.33 |
| 4,774,739 | A | | 10/1988 | Sherman, Jr. | |
| 4,919,558 | A | * | 4/1990 | Mascitelli et al. | 403/9 |
| 5,018,234 | A | * | 5/1991 | Meyer et al. | 15/104.33 |
| 5,493,748 | A | | 2/1996 | Santo | |
| 5,572,763 | A | * | 11/1996 | Eguchi | 15/167.1 |
| 5,809,601 | A | | 9/1998 | Rivera | |
| 6,154,913 | A | * | 12/2000 | Burton | 15/160 |
| 6,295,681 | B1 | | 10/2001 | Dolah | |

(Continued)

*Primary Examiner* — Vanitha Elgart

(57) ABSTRACT

A pipe cleaning device having a base; a plurality of bristles disposed on the base; and a connecting component disposed on the base, the connecting component is generally rectangular in cross section and has a first channel disposed therein, the connecting component is for engaging a standard attachment piece on a snake cable, the attachment piece being generally U-shaped with a first wing and a second wing each extending upwardly from a base platform, wherein a second channel is disposed in the first wing and a third channel is disposed in the second wing; wherein the connecting component can be inserted in between the first wing and the second wing such that the first channel is aligned with the second and third channel, wherein a screw can be threaded through the first, second, and third channel to secure the base to the snake cable.

1 Claim, 5 Drawing Sheets

U.S. PATENT DOCUMENTS 6,488,439 B1 * 12/2002 Lackey, Sr. ..... 403/305
6,857,157 B1 * 2/2005 Hoyle ..... 15/104.05
7,124,882 B1 * 10/2006 Jadydy ..... 206/234
8,186,092 B2 * 5/2012 Williams ..... 42/95
2005/0028307 A1 * 2/2005 Wu ..... 15/104.33
2006/0277811 A1 * 12/2006 Peterson ..... 42/95

* cited by examiner

Alt. Embodiment different size
brushes

PIPE CLEANING DEVICE

FIELD OF THE INVENTION

The present invention is directed to devices for cleaning pipes, more particularly to an elongated device having bristles that function to clean or unclog a pipe.

BACKGROUND OF THE INVENTION

The use of spring cable devices for cleaning clogged drains and pipes is well known. These devices (e.g., snakes) include a length of spring cable which can be forced into a clogged drain. The present invention features a pipe cleaning device for attaching to a spring cable device (e.g., snake). The pipe cleaning device comprises a plurality of bristles that function to clean or unclog the pipe.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

DESCRIPTION OF PREFERRED EMBODIMENTS

Referring now to FIGS. 1-6, the present invention features a pipe cleaning device 100 for cleaning or unclogging a pipe 500. The pipe cleaning device 100 comprises a base 200 having a head and an end. A plurality of bristles 250 is attached to the outside surface (e.g., all over or on a portion) of the head of base 200. The base 200 and bristles 250 are for inserting into a clogged or dirty pipe 500. In some embodiments, the base 200 is generally cylindrical (see FIG. 1, FIG. 2).

Figure 1:
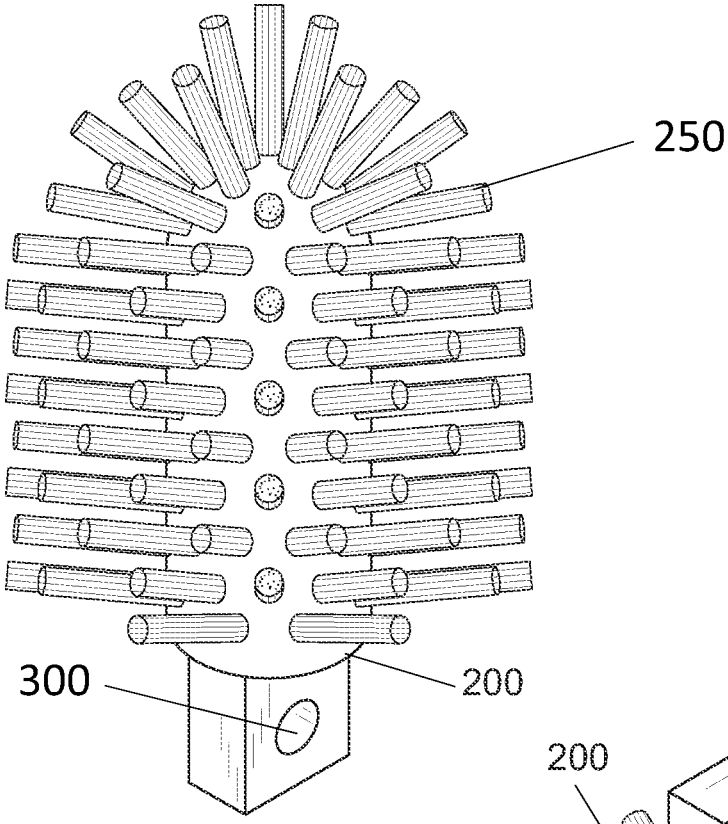
FIG. 1 is a first perspective view of the pipe cleaning device of the present invention.
Figure 2:
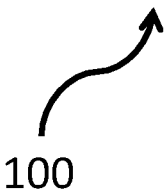
FIG. 2 is a second perspective view of the pipe cleaning device of FIG. 1.
Figure 2:
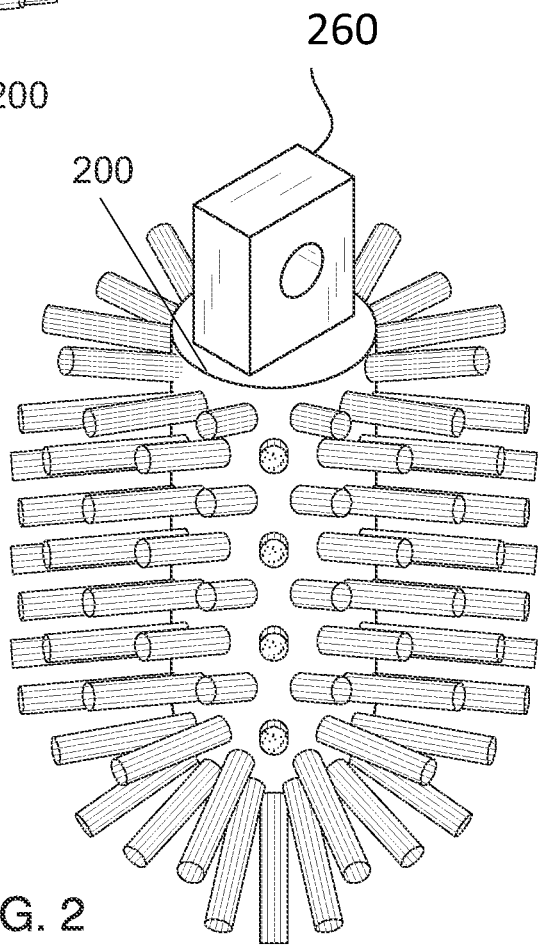
Figure 3:
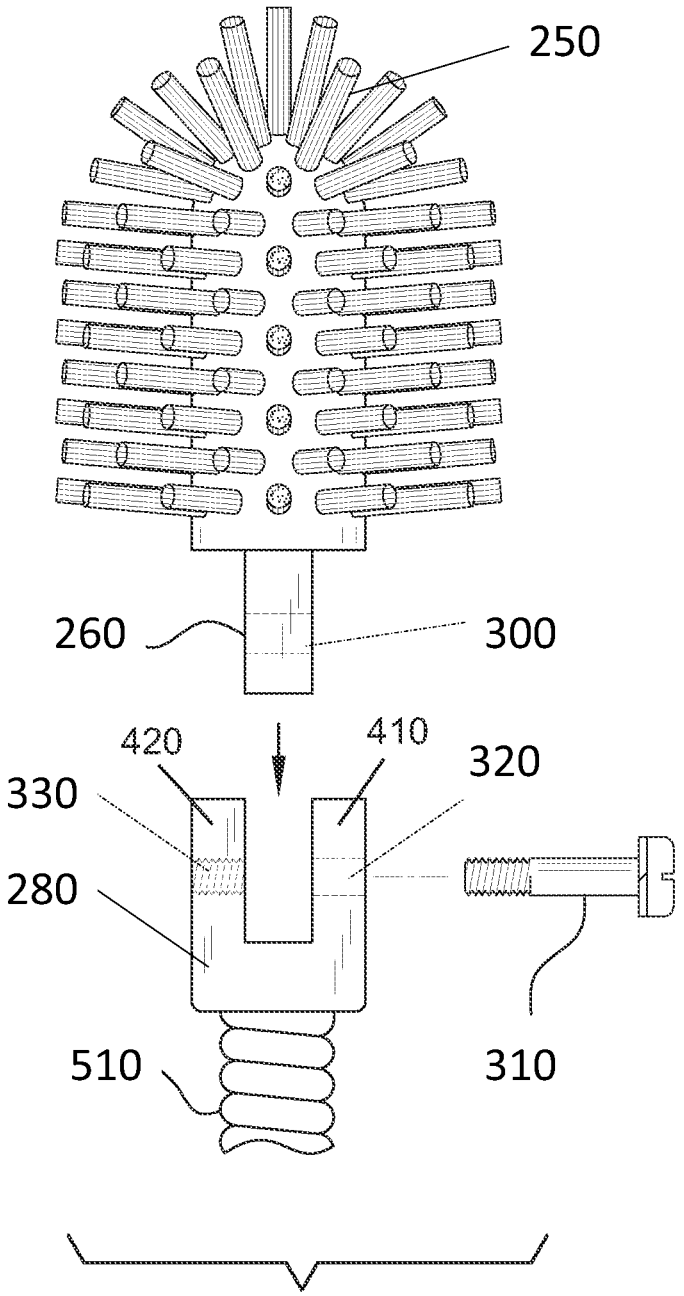
FIG. 3 is a side view and partial cut-away view of the pipe cleaning device of the present invention.

Disposed on the end of the base 200 is a connecting component 260 for connecting the base 200 to a snake cable 510. In some embodiments, the connecting component 260 is generally rectangular in cross section. In some embodiments, a first channel 300 is disposed in the connecting component 260. The first channel 300 can be used to attach the connecting component 260 to an end of a snake cable 510 (e.g., an attachment piece 280 on an end of a snake cable 510). Attachment pieces on snake cables are well known to one of ordinary skill in the art. For example, as shown in FIG. 3, the attachment piece 280 is generally U-shaped having a base platform and a first wing 410 and a second wing 420 each extending upwardly from the base platform (e.g., the wings 410, 420 being generally parallel to each other). The base platform is attached to the end of the snake cable 510.

A second channel 320 is disposed in the first wing 410 and a third channel 330 is disposed in the second wing 420. The second channel 320 and third channel 330 are generally aligned with one another. The second channel 320 and third channel 330 are configured to receive a screw 310 or bolt (e.g., a screw 310 or a bolt can be threaded through the second channel 320 and the third channel 330). In some embodiments, a nut is used to secure the screw 310 or bolt in the second channel 320 and third channel 330.

The connecting component 260 can be inserted in between the first wing 410 and the second wing 420 of the attachment piece 280. The insertion direction is perpendicular to the first, second and third channels. The first channel 300 should be aligned with the second channel 320 and the third channel 330. The third channel 330 is threaded. A screw 310 or bolt can be threaded through the first channel 300, the second channel 320, and the third channel 330 to secure the base 200 to the snake cable 510 via thread engagement between the screw or bolt and the threaded third channel (e.g., via the connecting component 260 and the attachment piece 280).

Figure 4:
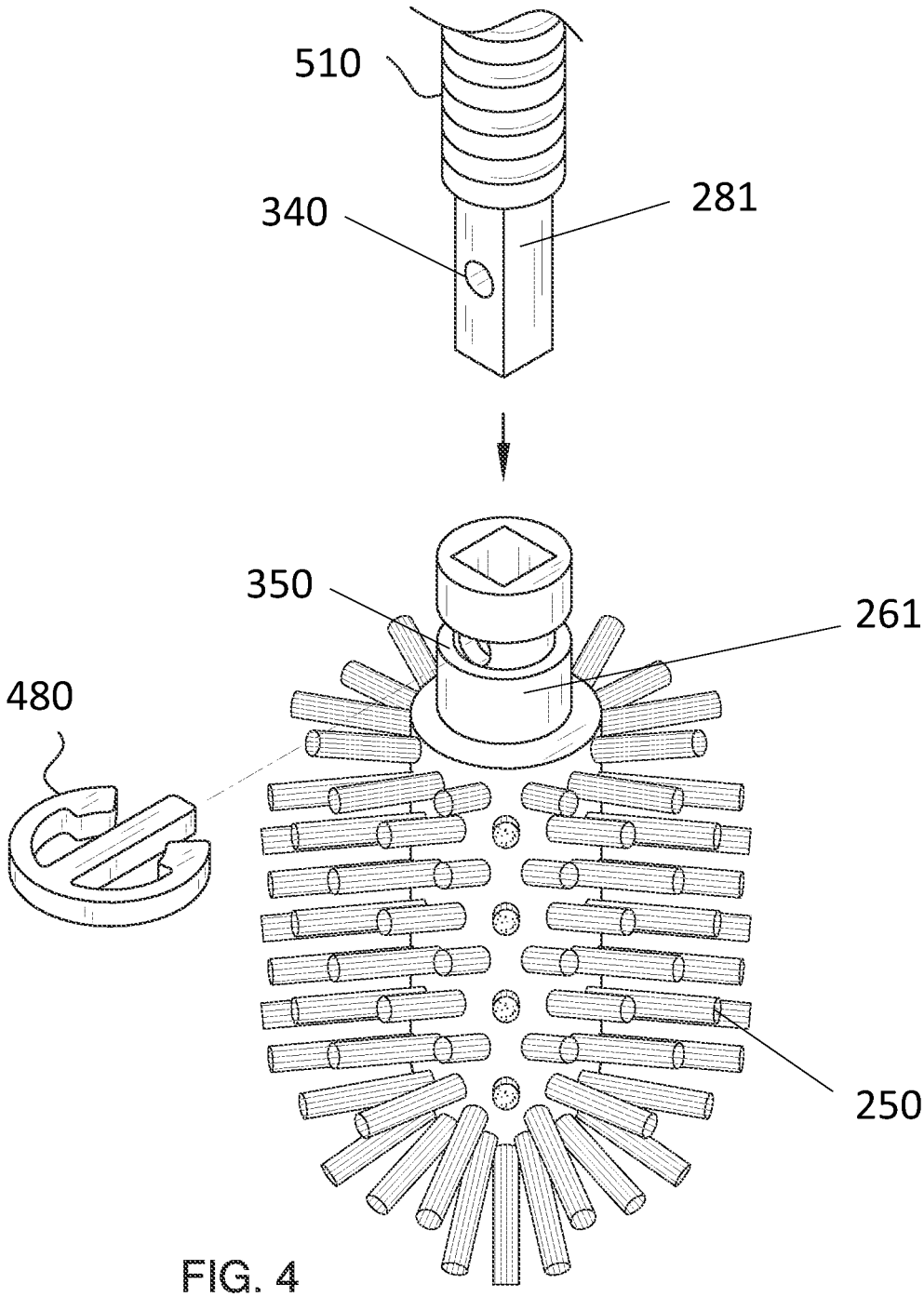
FIG. 4 is an exploded view of an alternative embodiment of the pipe cleaning device of the present invention.

As shown in FIG. 4, alternatively, a attachment piece 281 is disposed on the snake cable 510. The attachment piece 281 may be generally rectangular in cross section (and elongated). In some embodiments, a first channel 340 is disposed in the attachment piece 281. The first channel 340 can be used to attach to the connecting component 260. In some embodiments, a connecting component 261 is disposed on the base 200 (e.g., the second end of the base 200) for engaging the attachment piece 281. As shown in FIG. 4, a slot may be disposed in an end of the connecting component 260, which is adapted to receive the attachment piece 281. A second channel 350 is disposed in the connecting component 261. The attachment piece 281 can be inserted into the second connecting component 261 such that the first channel 340 and the second channel 350 are aligned. A user can insert a screw, a bolt, or an e-ring 480 through the fourth channel 340 and fifth channel 350 so as to secure the second connecting component 261 and the second attachment piece 281 together.

Figure 6:
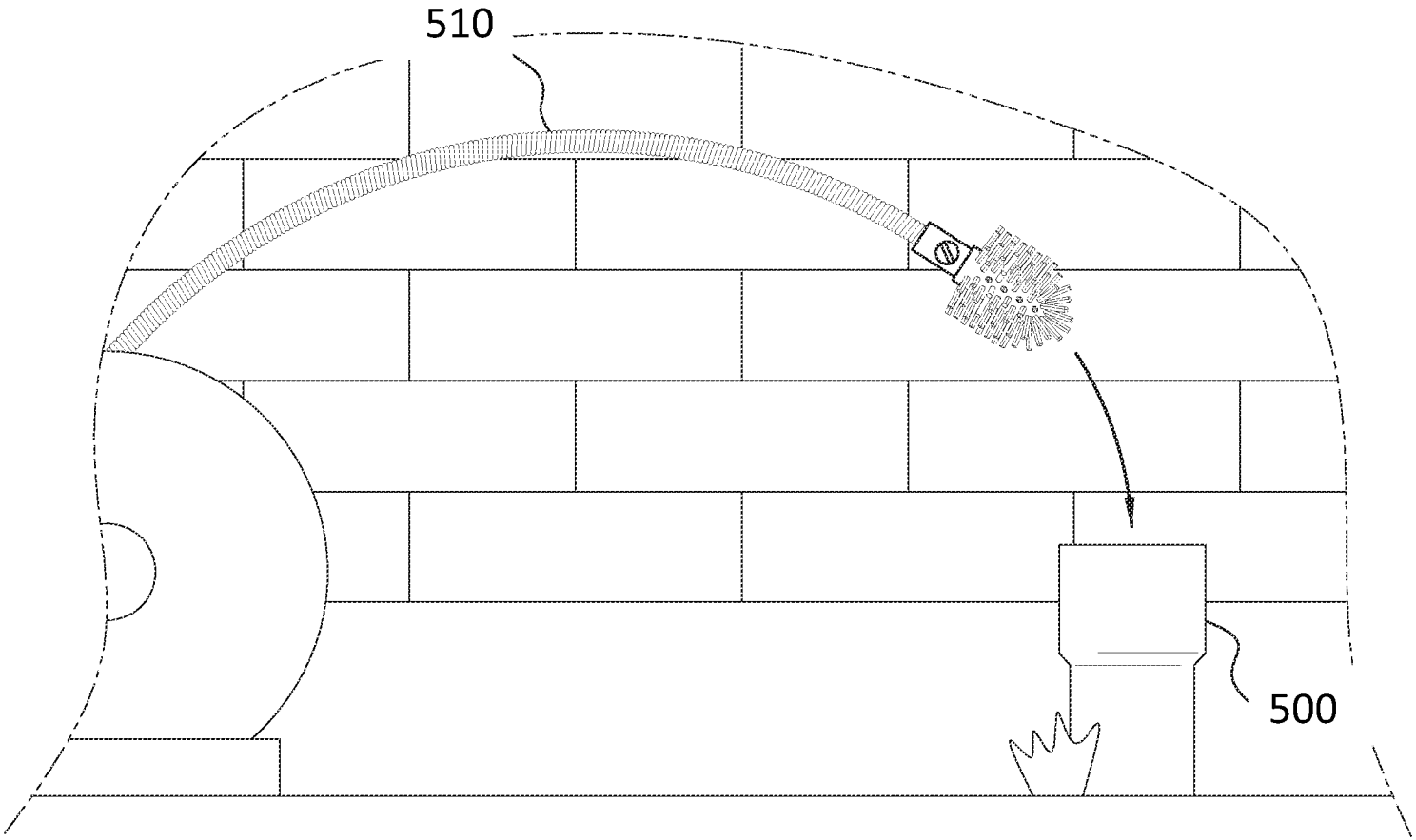
FIG. 6 is a side view of the pipe cleaning device of the present invention in use.

As shown in FIG. 6, the base 200 with bristles 250 (once attached to the snake cable 510) can be inserted into a pipe 500.

The pipe cleaning device 100 of the present invention may be used with any standard electrically powered drain cleaning machine to clear a clogged drain line or pipe.

As used herein, the term "about" refers to plus or minus 10% of the referenced number. For example, an embodiment wherein the base 200 is about 2 inches high includes a base 200 that is between 1.8 and 2.2 inches high.

Figure 5:
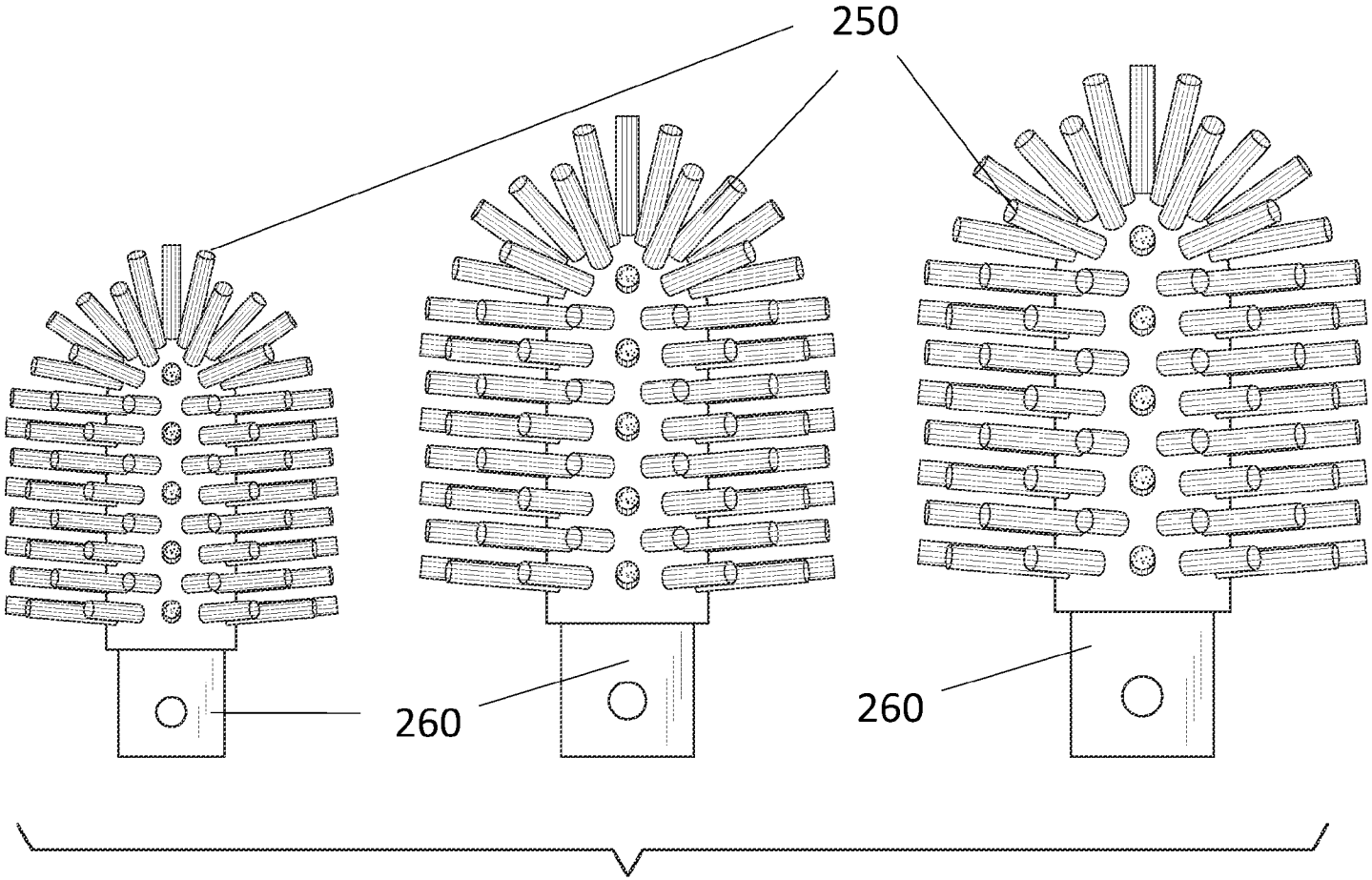
FIG. 5 is a side view of various sizes of pipe cleaning devices of the present invention.

The pipe cleaning device 100 may be constructed in a variety of sizes (e.g., see FIG. 5). For example, the diameter of the base 200 may correspond to the diameter of a drain line to be unclogged. For example, in some embodiments, the base 200 is between about 1 to 3 inches in diameter. In some embodiments, the base 200 is between about 3 to 6 inches in diameter. In some embodiments, the base 200 is greater than about 6 inches in diameter.

In some embodiments, the base 200 with bristles 250 is between about 1 to 1.5 inches in diameter. In some embodiments, the base 200 with bristles 250 is between about 1.5 to 2 inches in diameter. In some embodiments, the base 200 with bristles 250 is between about 2 to 3 inches in diameter. In some embodiments, the base 200 with bristles 250 is between about 3 to 4 inches in diameter. In some embodiments, the base 200 with bristles 250 is between about 4 to 5 inches in diameter. In some embodiments, the base 200 with bristles

250 is between about 5 to 6 inches in diameter. In some embodiments, the base 200 with bristles 250 is more than about 6 inches in diameter (e.g., 8 inches, 9 inches, 10 inches, 11 inches, 12 inches).

In some embodiments, the base 200 is between about 1 to 3 inches in height as measured from the first end to the second end. In some embodiments, the base 200 is between about 3 to 6 inches in height as measured from the first end to the second end.

The bases 200, bristles 250, and/or the snake cable 510 may be constructed in a variety of sizes, not just the sizes that are commonly used in the industry (see FIG. 5).

The pipe cleaning device 100 may be constructed from a variety of materials. For example, in some embodiments, pipe cleaning device 100 is constructed from a material comprising a metal (e.g., metal wires), a nylon (e.g., nylon bristles), a plastic (e.g., plastic bristles), the like, or a combination thereof.

The following the disclosures of the following U.S. Patents are incorporated in their entirety by reference herein: U.S. Pat. No. 6,295,681 B1: U.S. Pat. No., 4,774,739; U.S. Pat. No. 566,110; U.S. Pat. No. 5,493,748; U.S. Pat. No. 5,809,601.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. A pipe cleaning system consisting of:

(i) a pipe cleaning device consisting of a first dome shaped brush, a second dome shaped brush, and a third dome shaped brush, wherein the first brush is larger than the second brush, and the second brush is larger than the third brush, wherein each of the brushes consists of:

(a) a base having a head and an end, wherein a plurality of bristles are disposed on an outside surface of the head;

(b) a connecting component disposed on the end of the base, the connecting component is generally rectangular in cross section and has a first channel disposed therein wherein each of the brushes is used interchangeably;

(ii) a snake cable, wherein a U-shaped attachment piece has a base platform attached to an end of the snake cable and a first wing and a second wing each extending upwardly from the base platform, wherein the first wing and the second wing being generally parallel to each other, wherein a second channel is disposed in the first wing and a third channel is disposed in the second wing, the second channel and the third channel being generally aligned with each other, wherein the third channel is threaded; and wherein the connecting component can be inserted in between the first wing and the second wing of the attachment piece such that the first channel is aligned with the second channel and the third channel, wherein the insertion direction of the connecting component is perpendicular to the first, second and third channels, wherein a screw or a bolt passes through each of the first channel and the second channel, and then threaded through the third channel to secure the base to the snake cable via thread engagement between the screw or bolt and the threaded third channel.

* * * * *